United States Patent [19]

Riniker et al.

[11] Patent Number: 4,506,838

[45] Date of Patent: Mar. 26, 1985

[54] COMMINUTION AND MIXING APPARATUS

[75] Inventors: Hans Riniker, Rupperswil; Walter Killer, 28, Bolleystrasse, 8006 Zürich, both of Switzerland

[73] Assignee: Walter Killer, Zürich, Switzerland

[21] Appl. No.: 460,777

[22] Filed: Jan. 25, 1983

[30] Foreign Application Priority Data

Jan. 26, 1982 [DE] Fed. Rep. of Germany ..... 3202308

[51] Int. Cl.[3] ..... B02C 19/00

[52] U.S. Cl. ..... 241/98; 241/101 B; 241/199.12; 241/206

[58] Field of Search ..... 241/66, 98, 101 B, 172, 241/189 R, 191, 192, 193, 194, 199.12, 204, 206; 366/297, 298, 299, 300

[56] References Cited

U.S. PATENT DOCUMENTS 1,475,638 11/1923 Low ..... 366/300

3,743,192 7/1973 Otto ..... 241/101 B

FOREIGN PATENT DOCUMENTS 2047244 3/1981 Fed. Rep. of Germany ..... 241/172

*Primary Examiner*—Mark Rosenbaum

[57] ABSTRACT

In a comminution and mixing apparatus, comprising a cylindrical container (1) for receiving the material to be treated and at least one drivable stirrer which is concentrically journalled relative to the axis (20) of the container and which extends substantially up to the inner wall region of the container, there is provided at least one tool which is eccentrically and rotatably journalled relative to the container axis (20) and is mounted on the stirrer (5) for rotation together therewith. The tool can be driven either at the same rotational speeds or at a different rotational speed from the stirrer (5) and its direction of rotation can also differ from that of the stirrer. As a result of this construction of the comminution and mixing apparatus it is possible to ensure ideal conditions for mixing and comminution in which encrustations of the material being treated and the formation of lumps are avoided.

22 Claims, 4 Drawing Figures

COMMINUTION AND MIXING APPARATUS

Figure 1:
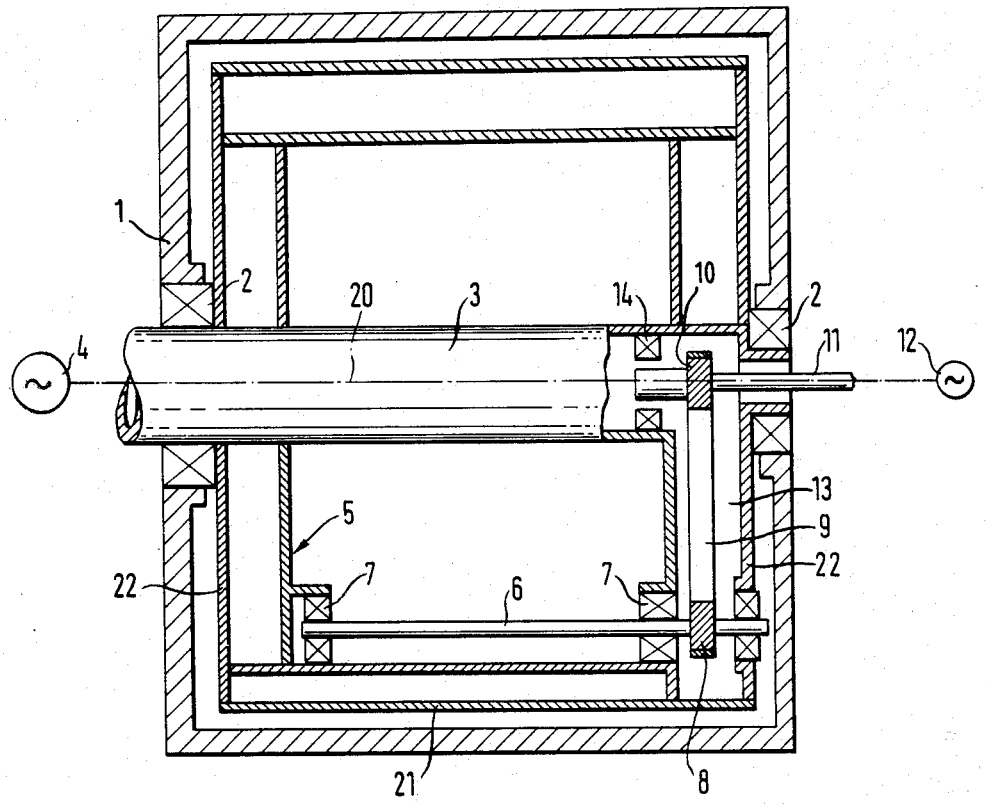

The invention relates to a comminution and mixing apparatus comprising a cylindrical container for receiving the material to be treated and at least one drivable stirrer concentrically journalled relative to the container axis and extending substantially up to the inner wall region of the container.

It is necessary when manufacturing many goods for industrial and private consumption to mix various types of materials with one another. Individual components of a mixture can cause considerable difficulties in obtaining a uniform distribution of the various components of the mixture. This can for example arise due to different specific gravities or bulk densities, or due to adhesive or cohesive forces or due to different surface structures of the materials. During mixing processes the material can often ball together in undesired manner. Such balling together of the material must be counteracted. For this purpose it is known to provide knives fixedly arranged in the container to counteract encrustation and the formation of lumps. The efficacy of these measures is not however entirely satisfactory.

The principal object underlying the invention is to so construct a comminution and mixing apparatus of the initially named kind that ideal treatment of the material is always ensured, with a short throughput or processing time, independently of the composition and condition of the material being treated in each case and while avoiding, as far as possible, encrustations and the formation of lumps.

This object is satisfied in accordance with the invention in that at least one tool is provided which acts on the stirred material, said tool being eccentrically and rotatably journalled relative to the container axis, rotating with the stirrer and being drivable either at the same rotational speed as, or at a different rotational speed and/or in a different direction from the stirrer.

As a result of this arrangement and the manner of operation of the tool, the relative speed between the material to be treated and the tool acting on the material is no longer determined solely by the speed of the stirrer but can instead be determined primarily by the speed of the tool. In this way ideal treatment of the material is always possible by selection of a suitable speed of rotation and/or direction of rotation of the tool, and also by selection of a tool suited to the particular purpose.

The tool preferably extends at least substantially over the same axial distance as the stirrer.

Furthermore, the tool advantageously lies adjacent the wall-side part of the stirrer. In this arrangement the tool expediently lies radially inside the wall-side part of the stirrer, it can however, in special cases, also be displaced in the peripheral direction relative to the wall-side part of the stirrer.

A particularly advantageous embodiment of the comminution and mixing apparatus comprises an arrangement in which the stirrer comprises a frame-like arrangement rotatably fixed to a carrier shaft concentrically journalled relative to the container axis, with the frame-like arrangement having at least one wall-side part extending substantially parallel to the container axis and two lateral support parts extending in a substantially radial direction and being adapted to carry the tool.

In this case the tool is preferably journalled in the support parts extending in the radial direction. This ensures that the tool is readily accessible so that it can, if necessary, be easily extracted and replaced by another tool.

In a further embodiment of the invention a second frame-like arrangement is provided which is likewise fixed to the carrier shaft for rotation therewith and which extends away from the carrier shaft in a diametrically opposite direction to the first frame-like arrangement.

In this arrangement the wall-side parts of the first and and second frame-like arrangements are expediently made of different radial thicknesses and only the frame-like arrangement having the wall-side part of smaller radial dimensions carries a tool. The frame-like arrangement having the wall-side part with thicker radial dimensions serves here exclusively for stirring the material to be treated.

In one, favoured, arrangement the wall-side part of the first frame-like arrangement has at least one inclined surface facing the tool for deflecting the material to be processed. In this way the feeding of the particular material to the tool can be improved.

A common drive is advantageously provided for the stirrer and the tool and acts on the tool via a transmission. The transmission can be a steplessly variable transmission or also a transmission with a variable direction of rotation.

In a preferred practical embodiment of the invention a second drive is provided for the tool and is independent of the first drive for the stirrer. As the provision of a separate second drive for the tool means that the speed of the tool can be completely independent of the speed of the stirrer it is possible to select an ideal relative speed between the tool acting on the material being treated and the material itself.

A motor with a steplessly variable speed is expediently used as the drive for the tool. This drive can advantageously take the form of a motor with a variable direction of rotation. As a result of this separate, second, drive the speed of the tool can be increased or reduced during a treatment phase in dependence on the changing condition of the material being treated. As the direction of rotation of the tool can also be varied a very wide range of variations is possible. As the speed of rotation and/or the direction of rotation of the tool can always be matched to the temporally varying condition of the material being treated, ideal conditions can be provided for each phase of the treatment.

In accordance with a further special feature of the invention the output drive shaft of the second drive is rotatably journalled in the carrier shaft for the stirrer and is connected with the tool via a transmission. In this way a relatively simple and stable construction is obtained which is economical of space. The output drive shaft can usefully be connected with the tool via a pulley transmission. Bands, cables, belts, chains and the like can be used to connect the rotating members of the pulley transmission with one another. It is also possible to use a gear transmission in place of the pulley transmission. The gear transmission can for example be a toothed transmission or also a friction transmission.

The transmission is expediently housed in a hollow cavity of the frame-like stirrer which is sealed so that the entry of the material to be treated into the hollow cavity, and the loss of lubricant from the hollow cavity, is prevented.

In practice the tool is selected in dependence on the composition of the material to be treated and also on the nature of the treatment process. The tool can for example consist of several tool parts which are mounted on a support shaft and individually exchangeable. If necessary the complete tool can also be exchanged for another. A tool is preferably used which counteracts balling together of the material to be processed. Useful tools are, for example, mixing tools and also comminution tools, such as cutting tools and tools which mill the material to be treated. Furthermore tools can be provided which are fixedly connected with the stirrer, or with the wall of the container, and which either cooperate with the rotatably journalled tool or also serve for additional processing of the material to be treated.

In specific applications in which the material to be treated has to be heated during the treatment process it is expedient to make the stirrer heatable.

Figure 2:
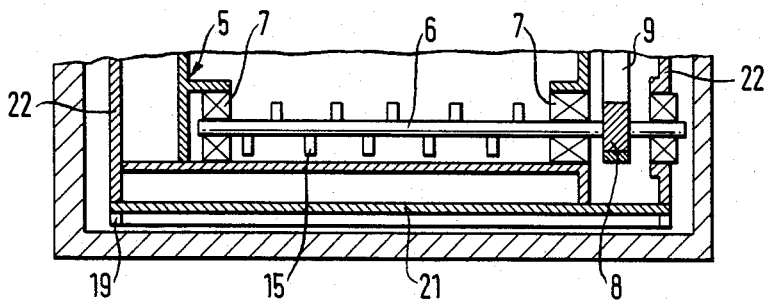
Figure 3:
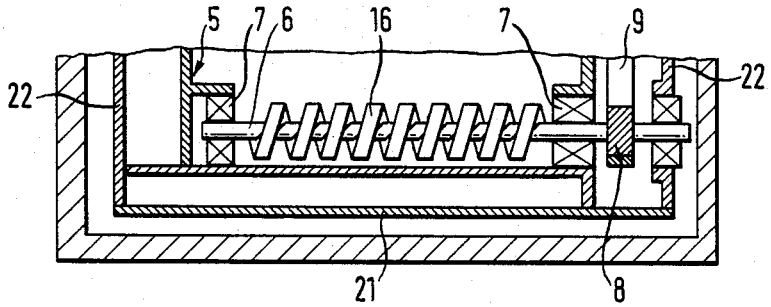
Figure 4:
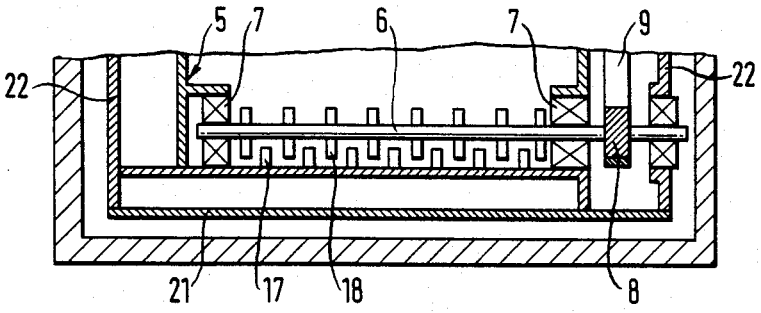

The invention will now be described in more detail with reference to embodiments and the drawings which show:

FIG. 1 a schematic sectional view of an embodiment of the comminution and mixing apparatus of the invention, FIG. 2 a view of part of the arrangement shown in FIG. 1 in which the tool acting on the material to be treated is a comminution tool, FIG. 3 a view of part of the arrangement shown in FIG. 1 in which the tool acting on the material to be treated is a mixing tool, and FIG. 4 a view of part of the arrangement shown in FIG. 1 in which the tool acting on the material to be treated is a milling tool.

In the arrangement of FIG. 1 a stirrer 5 is disposed in a cylindrical container 1. The stirrer 5 is fixedly connected to a carrier shaft 3 for rotation therewith. The carrier shaft 3 is rotatably journalled, concentrically to the container axis 20, by means of bearings 2 in the container. The stirrer 5 is constructed as a frame-like arrangement which extends substantially up to the inner wall region of the container 1. The frame-like stirrer includes a part 21 which extends parallel to the container axis 20 and also two lateral support parts 22 which extend in the radial direction. The parts 21 and 22 can for example be fabricated from rectangular hollow sections. A tool which acts on the material to be treated, and of which only the shaft 6 is shown in FIG. 1, is rotatably journalled by means of bearings 7 in the two lateral support parts 22 radially inside the wall-side part 21 of the stirrer 5. Individual tool parts can be fixedly rotatably connected with this tool shaft 6. The tool can however also be manufactured in one piece with this drive shaft 6. In addition to a first drive 4 for the stirrer 5 there is also provided a second drive 12 for the tool, with the second drive 12 being independent of the first drive. The output drive shaft of the second drive 12 is rotatably journalled in the support shaft 3 for the stirrer 5 by means of bearings 14 and is connected with the tool 6 via a transmission 8, 9, 10. The transmission includes a pulley 8 rotatably fixedly connected with the drive shaft 6, a pulley 10 rotatably fixedly connected with the output drive shaft 11 on the second drive 12 and also a belt 9 which transmits the drive power from the output drive shaft 11 to the tool shaft 6. The transmission is housed in a hollow cavity 13 of the right-hand lateral support part 22 of the stirrer 5. The hollow cavity 13 is sealed, so that both penetration of the materials to be treated into the hollow cavity and the escape of lubricant from the hollow cavity are prevented.

If the frame-like stirrer 5 is set in rotation by the first drive 4 the material to be treated will be stirred, i.e. revolved, rotated, turned over, in known manner. The material to be processed will in particular be given a predetermined speed in the peripheral region of the stirrer 5 namely in the region of the wall-side part 21. The relative speed between the material to be treated and the tool acting on the material can be ideally specified via the second drive 12. In general the tool is driven at a significantly higher speed than the stirrer. By way of example a speed of rotation of 2 rpm for the stirrer and about 1,500 rpm for the tool are conceivable. It is of practical significance that the speed of the tool shaft 6, i.e. of the tool, can be varied by the separate, second, drive 12 during a specific stage of the treatment, in dependence on the prevailing condition of the material being treated, even when the speed of the stirrer remains constant. In this way conditions can always be provided in which the formation of lumps of the material being treated is effectively avoided.

In accordance with the embodiment shown in FIG. 2 the tool is a comminution tool with cutting knifes 15 arranged on the tool shaft 6. These cutting knifes counteract balling together of the material to be treated. The wall-side part 21 of the stirrer 5 has a stripper 19 to prevent encrustations building up on the inner wall of the cylindrical container.

In accordance with the embodiment of FIG. 3 the tool is a mixing tool with a mixing screw 16 arranged on the tool shaft 6.

In the arrangement of FIG. 4 a tool which mills the material to be treated is used, with the tool shaft 16 having milling pins 18 which cooperate with milling pins 17 arranged on the wall side part 21 of the stirrer 5.

The tool shaft 6 of the tools shown in FIGS. 2 to 4 is journalled in each case in the same manner in the lateral support parts 22 of the stirrer 5 as was explained earlier in relation to the first embodiment with reference to FIG. 1.

We claim:

1. Comminution and mixing apparatus comprising a container for receiving material to be treated, said container having a side wall, first and second end walls and an axis; at least one drivable stirrer disposed within said container, said drivable stirrer having a drive shaft with an axis of rotation coaxial to said container axis, first and second arms extending radially away from said axis of rotation parallel to said first and second end walls of said container and a stirrer element interconnecting said arms and extending substantially parallel to said side wall; a rotatable material processing tool extending parallel to said stirrer element and having first and second ends; bearing means at each of said radially extending arms for supporting said first and second ends of said material processing tool; first drive means for rotating said drive shaft whereby to rotatably drive said stirrer element about said axis of rotation within said container at a first speed of rotation; second drive means for rotating said rotatable material processing tool at a second speed of rotation selectable independently of said first speed of rotation, said second drive means comprising a drive axle extending coaxially to said drive shaft and a transmission connecting said drive axle to said tool, wherein said second arm is hollow and wherein said transmission is located in said hollow second arm.

2. Apparatus in accordance with claim 1 wherein said container is cylindrical.

3. Apparatus in accordance with claim 2 wherein first and second bearings are provided at said first and second end walls to rotatably support said drive shaft.

4. Apparatus in accordance with claim 3 wherein further bearing means is provided in said drive shaft for supporting said drive axle.

5. Apparatus in accordance with claim 1 wherein said drive shaft is hollow and extends from said first end wall to said second end wall, and wherein said drive axle extends at least partially within said drive shaft.

6. Apparatus in accordance with claim 5 wherein said first arm and said stirrer element are also hollow, and wherein said first arm, said stirrer element and said second arm form a first frame-like arrangement, with said first and second arms being secured to said drive shaft.

7. Apparatus in accordance with claim 6 wherein a second frame-like arrangement is provided, said second frame-like arrangement being likewise fixed to said shaft for rotation therewith, and extending away from said shaft in a diametrically opposite direction to said first frame-like arrangement.

8. Apparatus in accordance with claim 7 wherein said second frame-like arrangement has a part disposed adjacent said side wall, and wherein said stirrer element is of smaller radial dimensions than said part.

9. Apparatus in accordance with claim 8 wherein only said first frame-like arrangement carries said material processing tool.

10. Apparatus in accordance with claim 9 wherein said stirrer element has at least one inclined surface facing said tool for deflecting the material to be processed.

11. Apparatus in accordance with claim 1 wherein said tool extends at least substantially over the same axial distance as said stirrer.

12. Apparatus in accordance with claim 1 wherein said tool is disposed radially inside of said stirrer element.

13. Apparatus in accordance with claim 1 wherein said tool is displaced in the peripheral direction relative to said stirrer element.

14. Apparatus in accordance with claim 1 wherein said second drive means is a motor with a steplessly variable speed of rotation.

15. Apparatus in accordance with claim 1 wherein said second drive means is a motor with a variable direction of rotation.

16. Apparatus in accordance with claim 1 wherein said transmission is a pulley transmission.

17. Apparatus in accordance with claim 1 wherein said transmission is a gear transmission.

18. Apparatus in accordance with claim 1 wherein said material processing tool is a tool for counteracting balling together of the material to be processed.

19. Apparatus in accordance with claim 1 wherein said material processing tool is a mixing tool.

20. Apparatus in accordance with claim 1 wherein said material processing tool is a comminution tool.

21. Apparatus in accordance with claim 20 wherein said comminution tool is a cutting tool.

22. Apparatus in accordance with claim 20 wherein said comminution tool is a tool for milling the materials to be processed.

* * * * *